US008584910B1

(12) United States Patent
Daly et al.

(10) Patent No.: US 8,584,910 B1
(45) Date of Patent: Nov. 19, 2013

(54) THUMBWHEEL-OPERATED DEVICE INCLUDING A COVER FOR OPENING AND CLOSING A DISPENSING PASSAGE

(76) Inventors: Paul D. Daly, Troy, MI (US); Elizabeth H. Daly, Troy, MI (US)

( * ) Notice: Subject to any disclaimer, the term of this patent is extended or adjusted under 35 U.S.C. 154(b) by 46 days.

(21) Appl. No.: 13/368,846

(22) Filed: Feb. 8, 2012

Related U.S. Application Data

(60) Provisional application No. 61/462,831, filed on Feb. 9, 2011.

(51) Int. Cl.
*B65D 47/00* (2006.01)

(52) U.S. Cl.
USPC ..... 222/545; 222/554

(58) Field of Classification Search
USPC ..... 220/213; 222/545, 548, 553, 554, 555, 222/560; 251/309, 312
See application file for complete search history.

(56) References Cited

U.S. PATENT DOCUMENTS

| | | | | | |
|---|---|---|---|---|---|
| 385,730 | A | * | 7/1888 | Schofield et al. | 222/545 |
| 1,630,555 | A | * | 5/1927 | Witt | 222/554 |
| 1,701,433 | A | * | 2/1929 | Witt | 222/545 |
| 1,701,949 | A | * | 2/1929 | Davenport | 222/545 |
| 1,772,379 | A | * | 8/1930 | Witt | 222/545 |
| 1,782,980 | A | * | 11/1930 | Ude | 222/554 |
| 1,867,182 | A | * | 7/1932 | Sicault | 222/521 |
| 1,882,697 | A | * | 10/1932 | Aldridge | 222/545 |
| 1,945,638 | A | * | 2/1934 | Herrick | 222/545 |
| 1,956,880 | A | * | 5/1934 | Stauffer | 222/541.1 |
| 2,026,646 | A | * | 1/1936 | Mull, Sr. et al. | 222/545 |
| 2,072,026 | A | * | 2/1937 | Cline | 222/545 |
| 2,106,377 | A | * | 1/1938 | Lomas | 222/554 |
| 2,126,815 | A | * | 8/1938 | Rest | 222/554 |
| 2,209,050 | A | * | 7/1940 | Church | 222/556 |
| 2,301,271 | A | * | 11/1942 | Folke | 222/542 |
| 2,682,355 | A | * | 6/1954 | Robbins | 222/107 |
| 2,764,323 | A | * | 9/1956 | Keenan | 222/363 |
| 2,851,204 | A | * | 9/1958 | Schwab | 222/545 |
| 3,777,950 | A | * | 12/1973 | Kiddon | 222/554 |
| 2005/0023306 | A1 | * | 2/2005 | Patz | 222/545 |

* cited by examiner

*Primary Examiner* — Kevin P Shaver
*Assistant Examiner* — Patrick M Buechner
(74) *Attorney, Agent, or Firm* — George L. Boller

(57) ABSTRACT

A device for selectively allowing and disallowing passage of semi-solid from a container. A housing has an inlet port through which semi-solid can enter, an outlet port through which semi-solid can exit, and a bore. A barrel fits, and can turn, within the bore. An operator outside the housing is operable to turn the barrel within the bore. The barrel has a through-passage which in a first position of operation by the operator, allows passage of semi-solid through the device by registering the inlet port to the outlet port. In a second position of operation passage of semi-solid is disallowed by the operator unregistering the inlet port to the outlet port. A cover external to the housing is selectively positionable with the barrel for occluding the outlet port in the second position and for not occluding the outlet port in the first position. Semi-solids include medicinal, edible, and non-edible materials.

20 Claims, 9 Drawing Sheets

THUMBWHEEL-OPERATED DEVICE INCLUDING A COVER FOR OPENING AND CLOSING A DISPENSING PASSAGE

FIELD

The present disclosure relates to a dispensing device for use on a container containing a semi-solid. The device is operable from a closed condition which disallows semi-solid from being dispensed through the device to an open condition which allows semi-solid to be dispensed through the device. After a quantity of semi-solid has been dispensed, the device can be operated back to closed condition.

BACKGROUND

Certain classes of materials are known as semi-solids, examples of which are toothpastes, petroleum jellies, lip balms, and ointments. These particular examples are typically intended for personal use. They are commercially sold in squeezable containers, such as synthetic plastic or soft metal tubes for example, which are closed by a removable cap. Removing the cap exposes an opening through which the semi-solid inside the container can be forced out by squeezing the container. After a desired quantity of semi-solid has been squeezed out, the cap can be replaced to close the container.

A container may have a neck to which a removable cap is fitted, such as by a screw thread connection or a snap-on, snap-off connection. A cap may or may not be tethered to a container. Typical use of such a container involves a person holding the container in one hand and using the other hand to remove and replace the cap.

SUMMARY OF THE DISCLOSURE

The disclosed dispensing device comprises a housing comprising an inlet port through which semi-solid from a container of semi-solid can enter the housing, an outlet port through which semi-solid which has entered the housing through the inlet port can exit the housing, and a bore.

A barrel fits, and can turn, within the bore.

An operator which is outside the housing is operable to turn the barrel within the bore.

The barrel comprises a through-passage which, when the operator has turned the barrel to a first position, allows passage of semi-solid through the device by registering the inlet port to the outlet port (open condition of the device), and which, when the operator has turned the barrel to a second position, disallows passage of semi-solid through the device by unregistering the inlet port to the outlet port (closed condition of the device).

A cover which is external to the housing is selectively positionable by the operator for occluding the outlet port when the operator has turned the barrel to the second position and for not occluding the outlet port when the operator has turned the barrel to the first position.

The disclosed dispensing device is intended for personal use to enable an individual to conveniently dispense a semi-solid from a squeezable container on which the device is mounted. One example of such use is dispensing a lip balm onto a person's lips. Convenience of use is achieved by enabling a person to single-handedly operate the device to open the container preparatory to squeezing the container, then to squeeze the container to force semi-solid from the container through the device, and then to operate the device to close the container after the semi-solid has been dispensed.

The foregoing summary is accompanied by further detail of the disclosure presented in the Detailed Description below with reference to the following drawings which are part of the disclosure.

DETAILED DESCRIPTION

Figure 1:
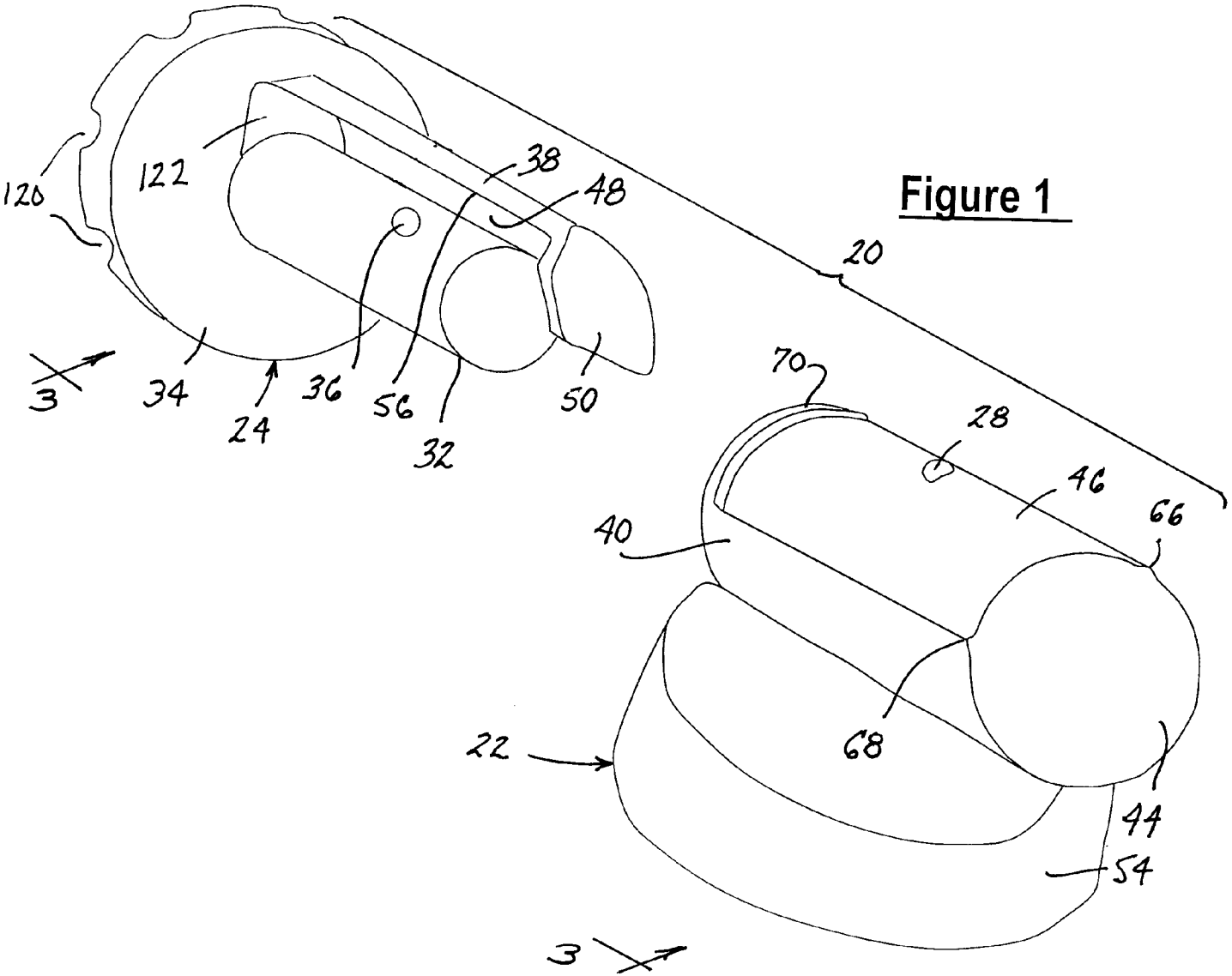
FIG. 1 is an exploded perspective view of two parts of a first embodiment.

FIGS. 1 through 5 show a device 20 for use on a container (the container is not shown in these Figures) which contains a semi-solid to selectively allow and disallow passage of semi-solid from the container through the device.

Device 20 comprises two parts: a housing 22 and a rotor 24. Housing 22 comprises an inlet port 26 through which semi-solid from a container of semi-solid can enter housing 22 and an outlet port 28 through which semi-solid which has entered housing 22 through inlet port 26 can exit the housing. Housing 22 also comprises a bore 30.

Rotor 24 comprises a barrel 32 which fits, and can turn, within bore 30. An operator 34 which is outside housing 22 is operable to turn barrel 32 within bore 30. Barrel 32 comprises a through-passage 36 which, when operator 34 has turned barrel 32 to a first position (shown in FIG. 4), allows passage of semi-solid through device 20 by registering inlet port 26 to outlet port 28, and which, when operator 34 has turned barrel 32 to a second position (shown in FIGS. 2 and 5), disallows passage of semi-solid through device 20 by unregistering inlet port 26 to outlet port 28.

Rotor 24 further comprises a cover 38 which is external to housing 22 and selectively positionable by operator 34 for occluding outlet port 28 when operator 34 has turned barrel 32 to the second position and for not occluding outlet port 28 when operator 34 has turned barrel 32 to the first position.

Figure 2:
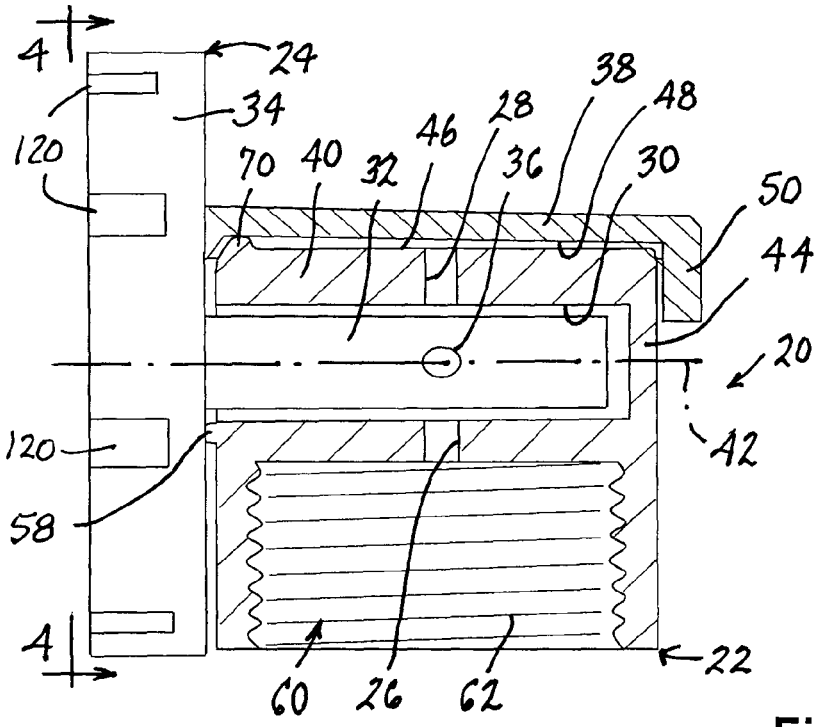
FIG. 2 is a non-exploded side elevation view of the first embodiment, partly in cross-section and showing the device in a second position of operation.

Housing 22 comprises a bore wall 40 which extends lengthwise of, and in circumferentially surrounding relationship to, bore 30 to define an axis of turning 42 for barrel 32 within bore 30. Barrel 32 has a circular outside surface which fits closely within a circular inside surface of bore 30. FIG. 2 shows clearance between the two on a slightly exaggerated scale for illustrative clarity only.

Inlet port 26 is disposed in one semi-circumference of bore wall 40, and outlet port 28 is disposed in an opposite semi-circumference of bore wall 40. The two ports 26, 28 are in alignment with each other across a diameter of bore 30.

Bore wall 40 has opposite axial ends between which inlet port 26 and outlet port 28 are disposed. At a first of those opposite axial ends, bore 30 is open. At a second of those opposite axial ends, bore wall 40 is closed by an end wall 44.

Barrel 32 protrudes from bore 30 at the open first axial end into an operative coupling with operator 34 for turning barrel 32 within bore 30 in correspondence with operation of operator 34. The operative coupling couples operator 34 with barrel 32 such that turning of operator 34 turns barrel 32 in unison with it about axis 42.

The semi-circumference of bore wall 40 which contains outlet port 28 has an exterior convex surface curvature 46 which is concentric with axis 42. Cover 38 comprises a concave surface curvature 48 which confronts exterior convex surface curvature 46. Concave surface curvature 48 occludes outlet port 28 when operator 34 has turned barrel 32 to the second position, and does not occlude outlet port 28 when operator 34 has turned barrel 32 to the first position. A tongue 50 extends from a distal end of cover 38 radially inward toward axis 42 to overlap end wall 44 and thereby cooperate with operator 34 to axially capture barrel 32, cover 38, and operator 34 on bore wall 40. The capture may provide some axial play to assure that operator 34 can turn barrel 32 and cover 38 without excessive resistance while maintaining through-passage 36 at a location along axis 42 that assures its registration with inlet port 26 and outlet port 28 when device 20 is operated to the first position by operator 34.

Operator 34 comprises at least a sector of a wheel having an outer perimeter which, relative to axis 42, is radially beyond cover 38. As shown in various drawing Figures, the disclosed operator 34 is a full wheel.

Figure 4:
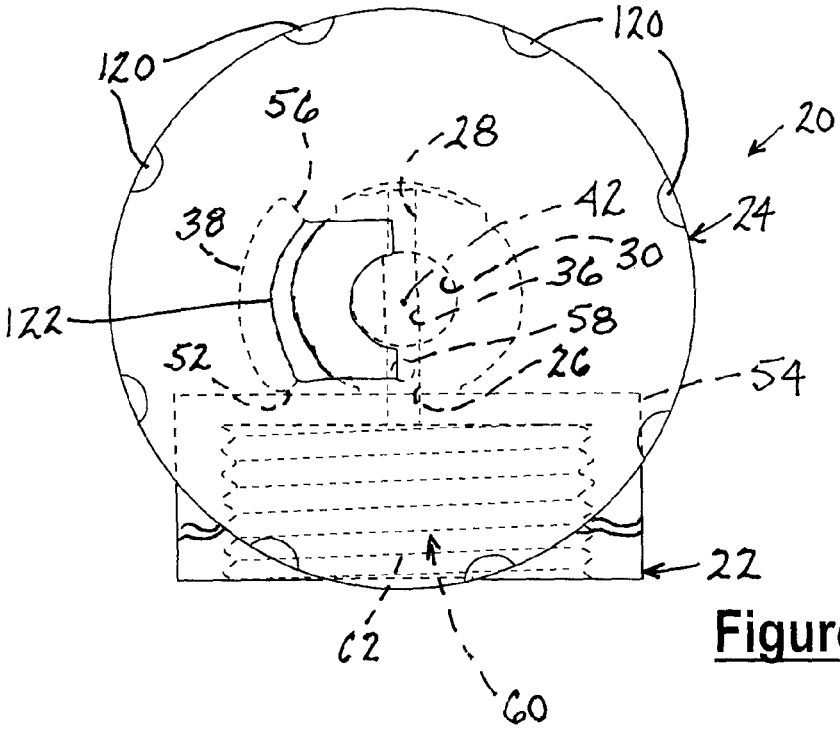
FIG. 4 is an end elevation view in the direction of arrows 4-4 in FIG. 2 illustrating a first position of operation.

A portion of housing 22 presents an interference to turning of cover 38 for setting at least one limit for a range of turning of operator 34, barrel 32, and cover 38 about axis 42. FIG. 4 shows a first axially extending side edge 52 of cover 38 contacting a top surface of a further wall 54 of housing 22 which adjoins bore wall 40. By limiting further counterclockwise turning of operator 34 when that contact occurs, device 20 enables a user who turns operator 34 to that position to sense when inlet port 26 is registered to outlet port 28 and outlet port 28 has ceased being occluded by cover 38. The circumferential extent of cover 38 between side edge 52 and a second side edge 56 is chosen to expose some of the exterior convex surface curvature 46 between outlet port 28 and second side edge 56 when side edge 52 is contacting the top surface of wall 54.

Figure 5:
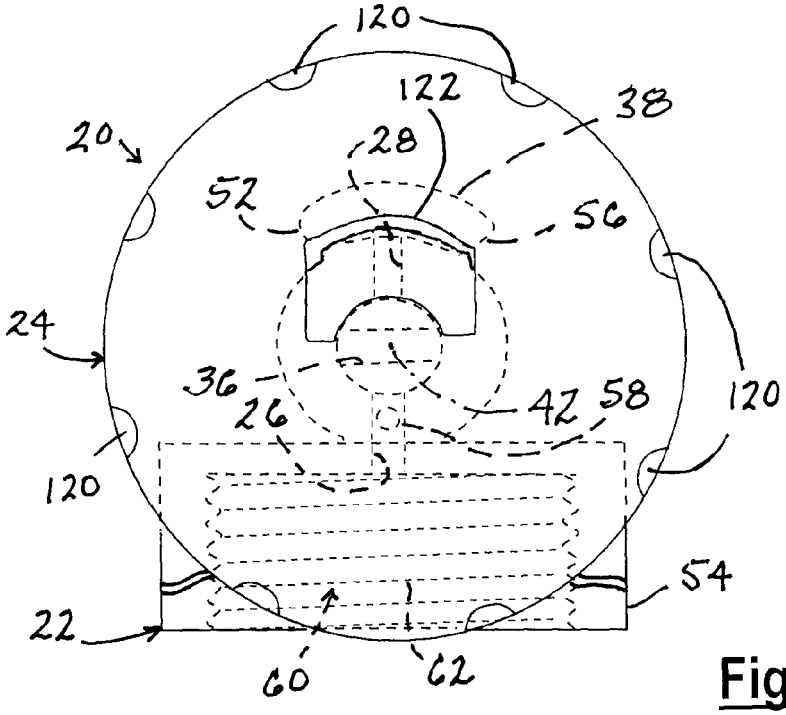
FIG. 5 is a view in the same direction as FIG. 4 illustrating the second position of operation.

FIG. 5 shows that when device 20 has been operated to the second position, cover 38 is essentially symmetric about axis 42. From this position operator 34 can be turned clockwise until further turning is stopped by abutment of side edge 56 with the top surface of wall 54 on the opposite side of bore wall 40 from where side edge 52 abutted the top wall surface of wall 54. This arrangement provides for bidirectional opening of device 20 from the center closed (second) position shown in FIG. 5.

Device 20 includes a detent feature which is effective to retain operator 34, barrel 32, and cover 38 at a position within the range of turning about axis 42. The drawings show that position to be the center closed (second) position. When the detent is engaged, a small bump 58 in the first axial end of bore wall 40 just below barrel 32 lodges in a shallow dimple in the confronting face of operator 34. That bump 58 will lodge in the dimple is assured by controlling the axial play along axis 42 between housing 22 and rotor 24. Bump 58 can be dislodged from the dimple without imposing excessive turning effort on operator 34.

A portion of wall 54 extends away from bore wall 40 in a direction transverse to bore 30 in circumferentially surrounding relationship to inlet port 26 and surrounds an opening 60 which is below, and open to, inlet port 26. An internal screw thread 62 around opening 60 provides for device 20 to be threaded onto an external thread of a container.

Figure 3:
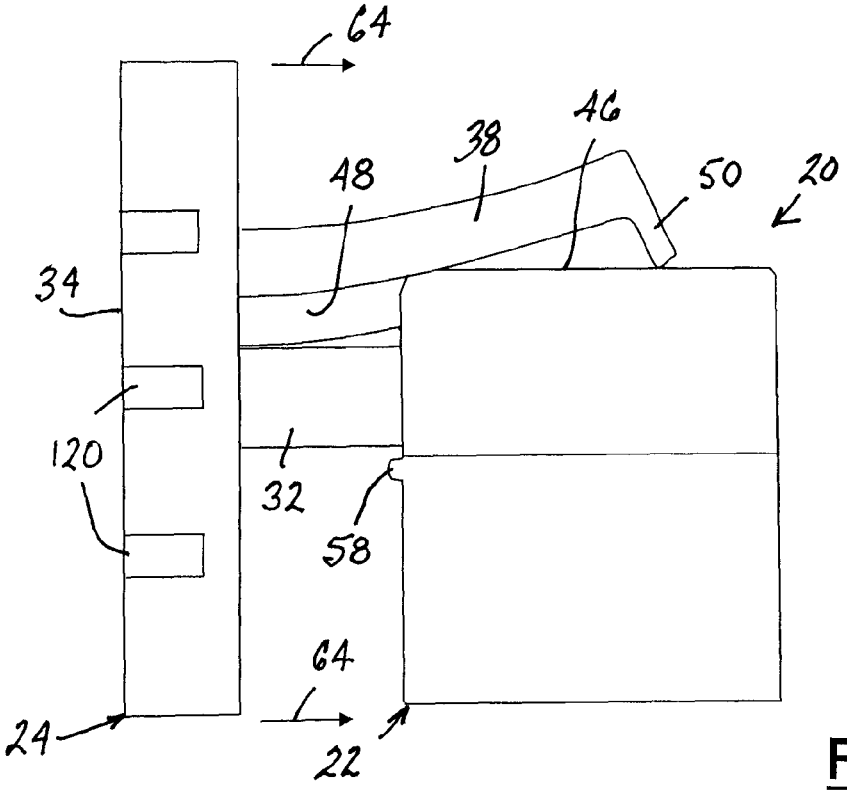
FIG. 3 is a side elevation view in the direction of arrows 3-3 in FIG. 1 showing a process of assembly of the two parts shown in FIG. 1.

FIG. 3 illustrates how housing 22 and rotor 24 are assembled. Barrel 32 is aligned with the open axial end of bore 30. Cover 38 is resiliently flexed away from barrel 32 to allow tongue 50 to ride along the outside of bore wall 40 as barrel 32 is inserted into bore 30 and rotor 24 is advanced in the direction indicated by arrows 64. Continued advancement of rotor 24 will eventually cause tongue 50 to ride off the end of bore wall 40 whereupon the resiliency of flexed cover 38 causes it to relax and move tongue 50 into overlap with end wall 44 as shown in FIG. 2.

Features present on exterior convex surface curvature 46 comprise slightly raised ridges 66, 68 which extend parallel with axis 42 and an arcuate raised ridge 70. When cover 38 is occluding outlet port 28, ridges 66 and 68 cooperate with cover 38 to resist potential intrusion of foreign material into the space between cover 38 and bore wall 40. Ridge 70 does the same between cover 38 and operator 34.

The reference numerals used in FIGS. 6 through 9 identify the same elements as the corresponding reference numerals used in FIGS. 1 through 5. The dimple which cooperates with bump 58 to form the detent is identified by reference numeral 72 in FIG. 7.

Figure 6:
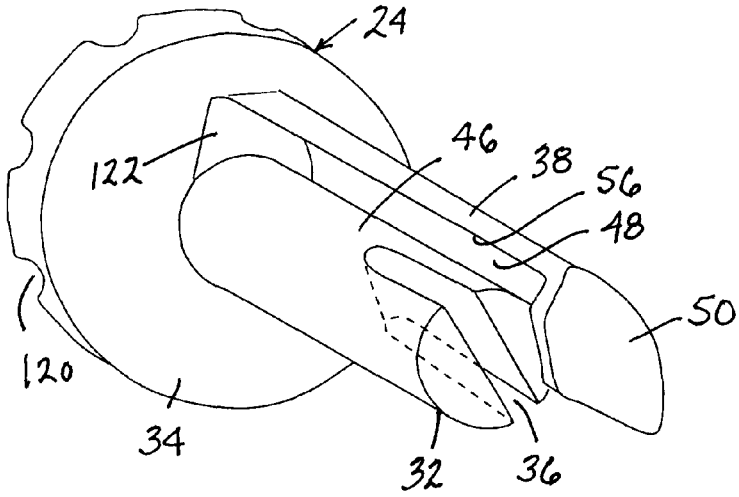
FIG. 6 is a perspective view of a modified form of one of the parts shown in FIG. 1.
Figure 7:
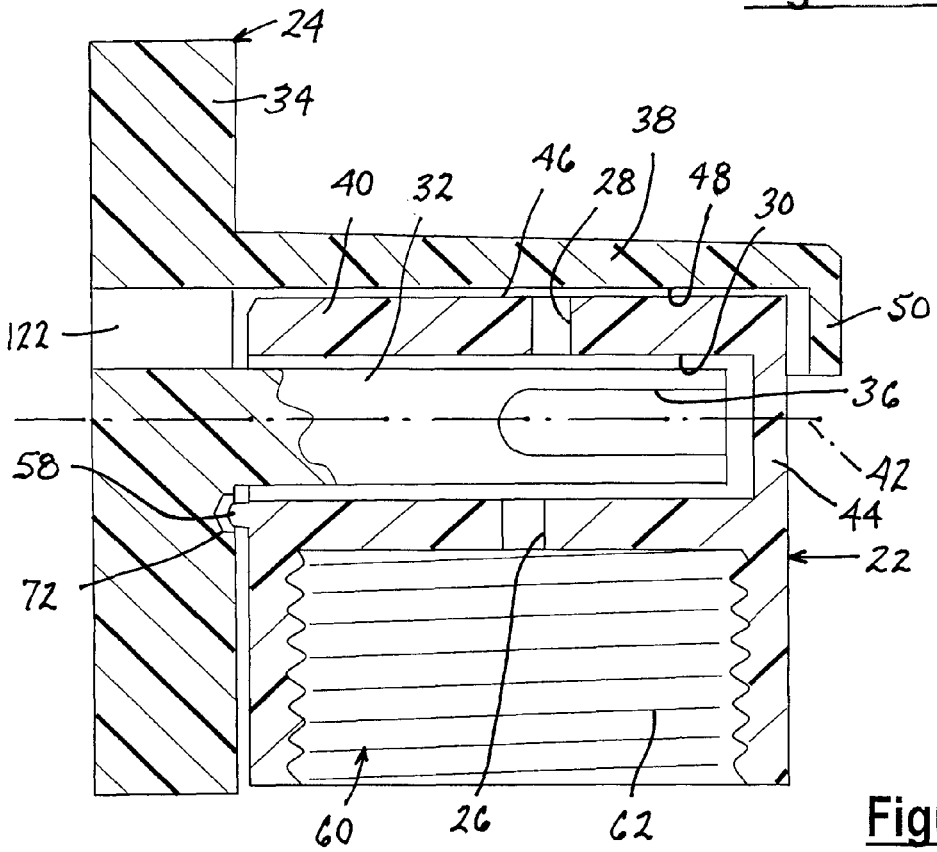
FIG. 7 is a cross-section view looking in the same direction as the view of FIG. 2 and showing a second embodiment which contains the part shown in FIG. 6.

The second embodiment shown in FIGS. 6 and 7 differs from the first in that outlet port 28 is offset from inlet port 26 in a direction toward end wall 44 and in that through-passage 36 comprises a slot extending from the distal end of barrel 32 to the location of inlet port 26. Placement of outlet port 28 more distant from operator 34 may make use of device 20 more convenient when applying semi-solid to a person's lips.

Figure 8:
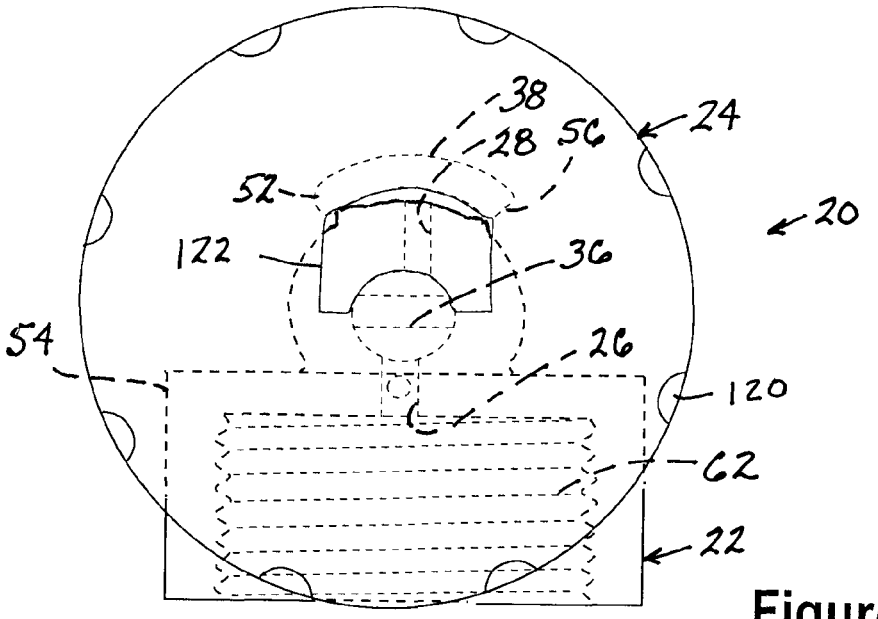
FIG. 8 is an end elevation view illustrating a third embodiment.

The third embodiment shown in FIG. 8 differs from the first embodiment in that outlet port 28 is offset from inlet port 26 in a direction which is transverse to axis 42. This shows that substantial alignment of inlet and outlet ports may be sufficient for dispensing semi-solid material.

Figure 9:
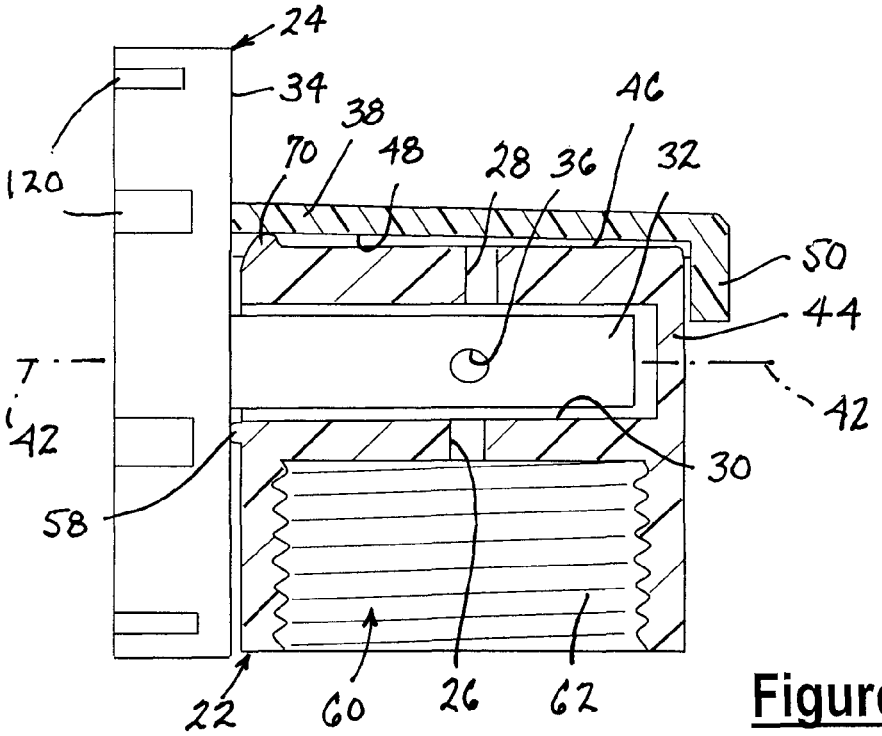
FIG. 9 is a side elevation view of a fourth embodiment, partly in cross-section and showing the device in a second position of operation.

The fourth embodiment shown in FIG. 9 differs from the first in that outlet port 28 is offset from inlet port 26 in a direction toward end wall 44.

Figure 10:
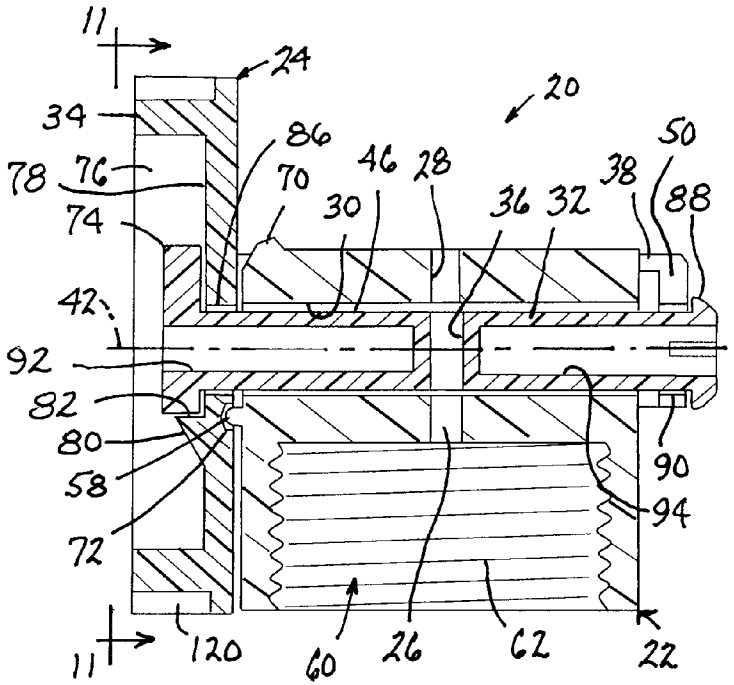
FIG. 10 is a cross section view looking, in the same direction as the view of FIG. 7, illustrating a fifth embodiment.
Figure 11:
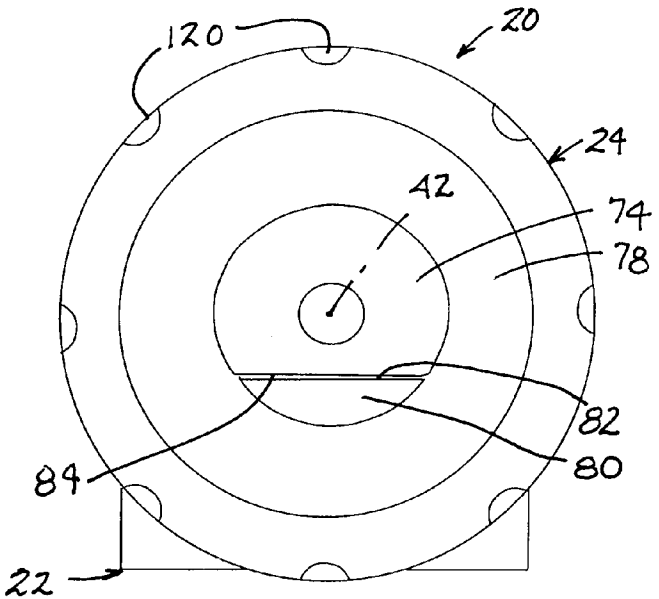
FIG. 11 is a full end elevation view in the direction of arrows 11-11 in FIG. 10.
Figure 12:
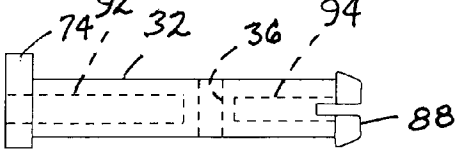
FIG. 12 is a side elevation view of one of the parts in FIG. 10 shown by itself.
Figure 13:
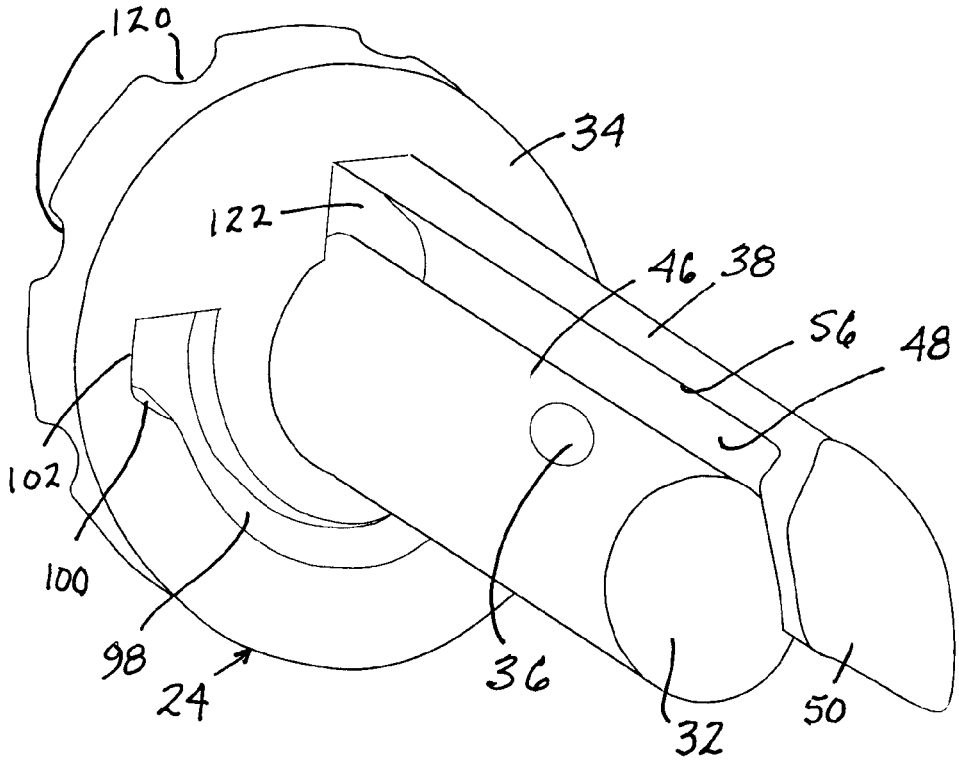
FIG. 13 is a perspective view similar to FIG. 6 illustrating one part of a sixth embodiment.

To the extent possible the reference numerals used in FIGS. 10 through 12 identify the same elements as the corresponding reference numerals used in FIGS. 1 through 5. FIGS. 10 through 12 illustrate a fifth embodiment which comprises three, rather than two, parts. Bore 30 is open at both axial ends, and rotor 24 comprises two separate parts, one being an operator 34 and the other being a barrel 32 which is shown by itself in FIG. 12.

Barrel 32 comprises a D-shaped head 74 which is keyed to operator 34 to turn barrel 32 within bore 30 in unison with turning of operator 34. In its outer end face, operator 34 comprises a circular cavity 76 which extends inward to a circular wall 78. A narrow ledge 80 extends outward from wall 78 within cavity 76 to provide a ledge surface 82 closely confronting a flat surface 84 of head 74. As operator 34 turns about axis 42, ledge surface 82 acts on surface 84 to force barrel 32 to also turn about axis 42. From head 74, barrel 32 extends along axis 42 through a circular hole 86 in circular wall 78 and into and through bore 30.

At its distal end, barrel 32 comprises what is sometimes called a rosebud catch 88. The three parts of the fifth embodiment are assembled together by placing operator 34 against the first axial end of bore wall 40 with circular hole 86 in alignment with bore 30. Barrel 32 is then inserted, rosebud catch 88 first, through hole 86 and through bore 30. As catch 88 passes through hole 86 and bore 30, its engagement with the hole and bore walls forces the catch to circumferentially contract, thereby allowing its passage through the hole and bore. Before barrel 32 can be fully inserted, head 74 is circumferentially oriented with operator 34 so that head surface 84 is parallel with ledge surface 82. As barrel 32 approaches full insertion, head surface 84 moves onto ledge surface 82, and catch 88 begins to enter a circular hole 90 in tongue 50. The engagement of catch 88 with the perimeter of hole 90 forces catch 88 to circumferentially contract during passage through hole 90. Once catch 88 clears hole 90, the resiliency of the flexed material of the catch circumferentially expands the catch to allow its barbs to overlap hole 90 on the outside of tongue 50 thereby retaining the three parts 22, 32, and 34 in an operative assembled relationship. Barrel 32 is shown with blind axial holes 92, 94 for conservation of material used to mold it.

FIGS. 13 through 16 show an embodiment which is similar to the second embodiment but differs in two respects. To the extent possible the reference numerals used in FIGS. 13 through 16 identify the same elements as the corresponding reference numerals used in earlier Figures. A first difference involves the detent for retaining operator 34, barrel 30 and cover 38 in the closed second position. A second difference involves association of cover 38 with housing 22 in the closed second position.

The detent mechanism comprises a tab 96 which is formed in housing 22 to project from the housing toward operator 34. The face of operator 34 which is toward housing 22 comprises an arcuate channel 98 within which a distal end of tab 96 is received. The circumferential length of channel 98 is concentric with axis 42, and the channel has essentially constant width as measured radially of axis 42 except at one circumferential end where its radially outer surface comprises a ramp 100 which progressively increases the radial width of channel 98 to a maximum along a short final segment 102 before the channel ends.

Figure 14:
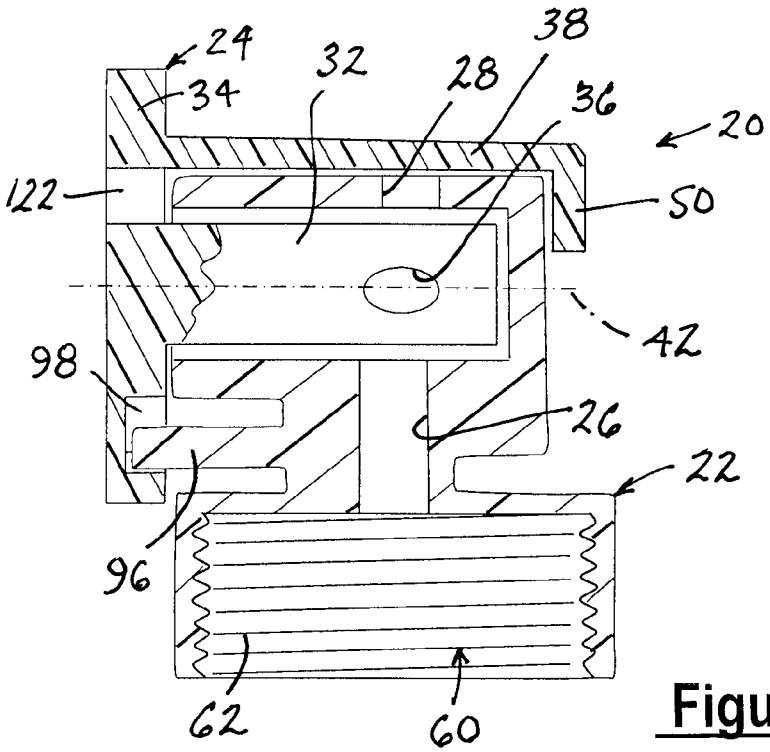
FIG. 14 is a view of the sixth embodiment, partly in cross-section and in the same direction as the view of FIG. 7, illustrating the second position of operation.
Figure 15:
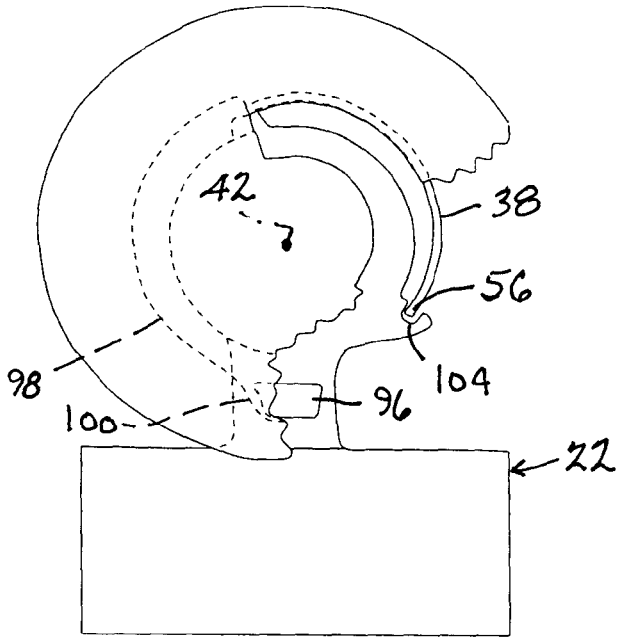
FIG. 15 is an end elevation view, with a portion broken away, of the sixth embodiment in the second position of operation.
Figure 16:
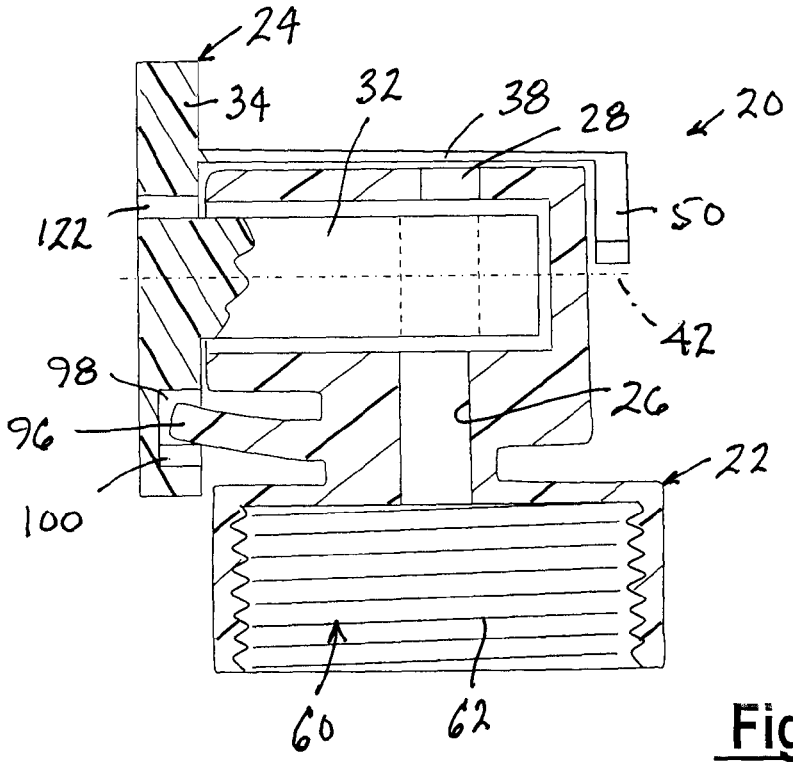
FIG. 16 is a view like FIG. 14, but illustrating the first position of operation.

FIGS. 14 and 15 show tab 96 in a relaxed condition lodging its distal end in the final segment of channel 98 for retaining operator 34, barrel 30 and cover 38 in the closed second position. FIG. 15 shows an inclined side surface of tab 96 confronting ramp 100. When operator 34 is initially turned in the counterclockwise sense as viewed in FIG. 15, ramp 100 acts as a cam against the inclined side surface of tab 96 to flex tab 96 so that continued turning of operator 34 forces the distal end of the flexed tab to ride in the narrower width portion of channel 98 at the same time that cover 38 is being turned, as shown in FIG. 16.

FIG. 15 also shows housing 22 formed with a groove 104 which extends parallel with axis 42 along the exterior of bore wall 40 and which is open in a circumferential direction allowing side edge 56 of cover 38 to fit inside it when device 20 is in the closed second position. When operator 34 is initially turned in the counterclockwise sense from the position shown in FIG. 15, edge 56 moves out of groove 104. When operator 34 has been turned far enough that tab 96 abuts the far circumferential end of channel 98 from ramp 100 thereby limiting circumferential counterclockwise turning as viewed in FIG. 15, through-hole 36 places inlet port 26 in registration with outlet port 28 and cover 38 ceases to occlude outlet port 28. The embodiment of FIGS. 13-16 provides unidirectional opening of device 20 from closed position.

Figure 17:
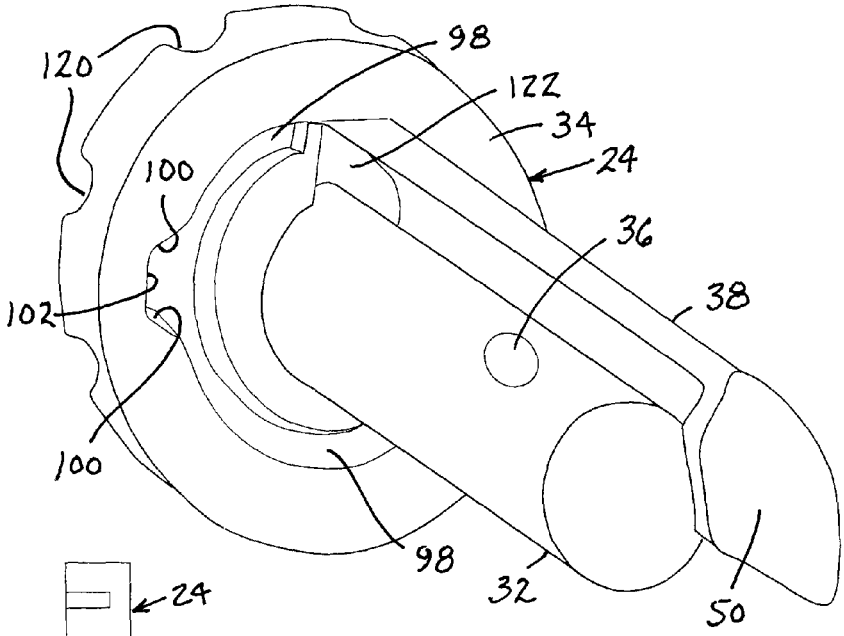
FIG. 17 is a perspective view of one part of a seventh embodiment.

The embodiment shown in FIG. 17 depicts a rotor 24 having a channel 98 which provides bidirectional opening of device 20 from closed position. There are ramps 100 on either side of wider segment 102, with narrower width portions of the channel extending from the ramps. Tab 96 is not shown but has inclined side surfaces on opposite sides for association with the respective ramps 100 to flex the tab when rotor is being turned from closed position. Also the circumferential location of cover 38 on wheel 32 relative to wider segment 102 is different from that shown in FIG. 13 in that cover 38 is symmetric relative to wider segment 102, and groove 104, when present, is also in a different circumferential location.

Figure 18:
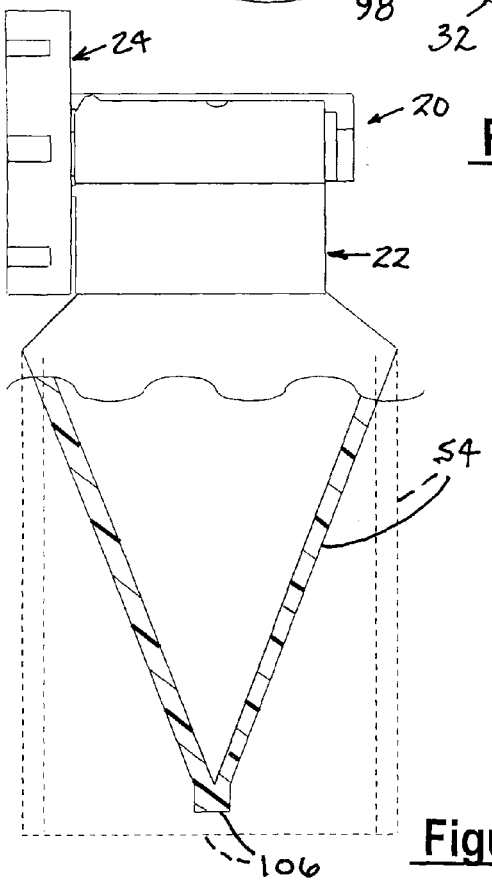
FIG. 18 is a side elevation view, partly in cross section, of an eighth embodiment.

The embodiment of FIG. 18 comprises a housing 22, a portion of which is used to form a container for semi-solid material unlike the previous embodiments in which housing 22 is formed with a portion of wall 54 circumferentially surrounding opening 60 which comprises a screw thread 62. The reference numerals used in FIG. 18 identify the same elements as the corresponding reference numerals used in earlier Figures. In FIG. 18, a portion of wall 54 is shown in broken lines in an "as-molded" condition, depending downwardly like a skirt. In this condition, housing 22 can be turned upside down and filled with semi-solid material after which the free margin 106 is pinched closed and sealed to create the shape shown in solid lines.

Figure 19:
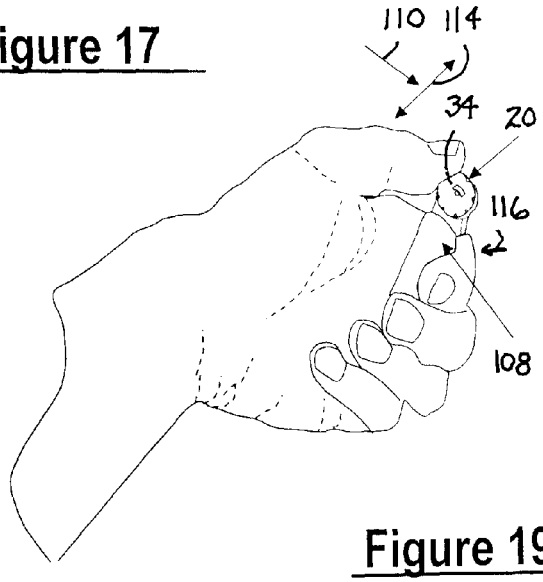
FIG. 19 is a perspective view illustrating a use of the device.

FIG. 19 shows a person using a device 20 on a squeezable container 108. Device 20 is initially in the closed position. Container 108 holds a semi-solid, such as a lip balm, and is being held in the person's left hand between the palm and the index and middle fingers. The thumb is flexed in the direction of arrow 110 against the perimeter of operator 34 and is then moved in one of the directions of arrow 114 appropriate for turning operator 34, and hence barrel 32, to operate device 20 to the open position and in doing so, to uncover outlet port 28. Squeezing container 108, as indicated by arrow 116, squeezes lip balm through device 20 and through outlet port 28, allowing the person to wipe the dispensed lip balm onto his or her lips. Thereafter, device 20 can be closed by operating device 20 to closed position.

It has been shown that device 20 enables a person to single-handedly open a squeezable container, squeeze the container to dispense semi-solid, and to close the container. This can be done even with a glove-covered hand.

The various embodiments which have been disclosed show that the outer perimeter of operator 34 comprises features which are intended to avoid slipping of a person's thumb when turning operator 34. While the features which are shown comprise circumferentially spaced notches 120, it is to be appreciated that other equivalent features, like knurling or roughening, may be used.

The parts of the various embodiments which have been disclosed can be fabricated using conventional molding technology. Various thermoplastic materials such as polyethylene, polypropylene, ABS, acetal, and polystyrene are suitable. An example of a molding process is described in the priority provisional patent application No. 61/462,831, the entirety of which is incorporated herein by reference. In the embodiments shown in FIGS. 1, 4-8, 13, 14, and 16, the reference numeral 122 refers to a tool clearance hole for a part of a molding tool. While the circular cylindrical shapes of barrel 32 and bore 30 are convenient for molding, certain embodiments not illustrated in the Figures may have a barrel and bore of other than circular cylindrical shape, provided that the barrel remains turnable within the bore.

The term semi-solid is intended to refer to various materials such as gels, creams, and ointments, and to materials which possess spreadable, flowable, or paste-like consistency. Such materials include not only medicinal ones, but also edible and non-edible materials.

What is claimed is:

1. A device for use on a container which contains a semi-solid to selectively allow and disallow passage of semi-solid through the device, the device comprising:

a housing comprising an inlet port through which semi-solid from a container can enter the housing, an outlet port through which semi-solid which has entered the housing through the inlet port can exit the housing, and a bore;

a barrel which fits, and can turn, within the bore;

an operator which is outside the housing and operable to turn the barrel within the bore between a first position and a second position;

the barrel comprising a through-passage which, when the operator has turned the barrel to the first position registers the inlet port to the outlet port to allow passage of semi-solid through the device, and which, when the operator has turned the barrel to the second position, unregisters the inlet port to the outlet port to disallow passage of semi-solid through the device;

and a cover which is external to the housing and selectively positionable by the operator for turning with turning of the barrel to occlude the outlet port when the operator has turned the barrel to the second position and to not occlude the outlet port when the operator has turned the barrel to the first position;

in which the housing comprises a bore wall which extends lengthwise of, and in circumferentially surrounding relationship to, the bore to define an axis of turning for the barrel within the bore, the outlet port is disposed in a first semi-circumference of the bore wall, and the inlet port is disposed in a second semi-circumference of the bore wall opposite the first semi-circumference, and in which the first semi-circumference of the bore wall has an exterior convex surface curvature which is concentric with the axis of turning and the cover comprises a concave surface curvature concentric with the axis of turning and confronting the exterior convex surface curvature of the first semi-circumference of the bore wall, the concave surface curvature having a surface area the entirety of which confronts the exterior convex surface curvature of the first semi-circumference of the bore wall throughout turning of the barrel about the axis of turning between the first position and the second position.

2. A device as set forth in claim 1 in which the bore wall has opposite axial ends between which the inlet port and the outlet port are disposed, and in which the barrel protrudes from the bore at a first of the opposite axial ends of the bore wall into an operative coupling with the operator which couples the barrel and operator for turning in unison about the axis of turning.

3. A device as set forth in claim 2 in which the cover joins with the operator for turning in unison with turning of the operator and the barrel about the axis of turning.

4. A device as set forth in claim 3 including a tongue which extends from the cover radially inward relative to the axis of turning to overlap a second of the opposite axial ends of the bore wall for cooperating with the operator to axially capture the barrel, the cover, and the operator on the bore wall throughout turning of the barrel about the axis of turning between the first position and the second position.

5. A device as set forth in claim 3 in which the operator comprises at least a sector of a wheel having an outer perimeter which, relative to the axis of turning, is radially beyond the cover for all positions of turning between the first position and second positions of turning of the barrel, including the first position and the second position.

6. A device as set forth in claim 5 in which a portion of the housing is disposed to present an interference to the cover at at least one of the first and second positions of turning of the barrel.

7. A device as set forth in claim 3 including an engageable detent which engages at a certain position within the range of turning of the barrel about the axis of turning of the barrel and is effective to retain the operator, the barrel, and the cover at the certain position.

8. A device as set forth in claim 7 in which the detent engages at the second position of turning of the barrel.

9. A device as set forth in claim 1 in which the housing comprises a further wall which joins with, and extends away from, the bore wall in a direction transverse to the bore and which circumferentially surrounds the inlet port, the further wall surrounding an opening which is below and open to the inlet port, the further wall comprising an internal screw thread around the opening which provides for the device to be threaded onto an external thread of a container.

10. A device as set forth in claim 1 in which the operator, the barrel, and the cover are embodied in a single molded part.

11. A device as set forth in claim 1 in which the barrel and the bore comprise circular cylindrical shapes.

12. A device for use on a container which contains a semi-solid to selectively allow and disallow passage of semi-solid through the device, the device comprising:

a housing comprising an inlet port through which semi-solid from a container can enter the housing, an outlet port through which semi-solid which has entered the housing through the inlet port can exit the housing, and a bore;

a barrel which fits, and can turn, within the bore;

an operator which is external to the housing and operable to turn the barrel within the bore;

the barrel comprising a through-passage which, when the operator has turned the barrel to a first position, registers the inlet port to the outlet port to allow passage of semi-solid through the device, and which, when the operator has turned the barrel to a second position, unregisters the inlet port to the outlet port to disallow passage of semi-solid through the device;

and a cover which is external to the housing and extends from the operator for selective positioning by the operator to occlude the outlet port when the operator has turned the barrel to the second position and to not occlude the outlet port when the operator has turned the barrel to the first position;

further comprising an engageable detent which is disposed between confronting surfaces of the operator and the housing for engagement at the second position.

13. A device as set forth in claim 12 in which the detent comprises a tab projecting away from the housing and the operator comprises an arcuate channel which has a circumferential length about the axis of turning, the arcuate channel having a circumferentially extending first surface, a circumferentially extending second surface at a greater radial distance from the axis of turning than the first surface, a ramp surface which joins the first surface and the second surface, the distal end of the tab being disposed over the second surface in the second position and then riding first along the ramp surface and subsequently along the first surface during turning of the barrel from the second position to the first position, causing the tab to flex as its distal end rides along the ramp surface and the first surface.

14. A device as set forth in claim 12 in which in which the housing comprises a bore wall which extends lengthwise of, and in circumferentially surrounding relationship to, the bore to define an axis of turning for the barrel within the bore, the inlet port is disposed in a first semi-circumference of the bore wall, and the outlet port is disposed in a second semi-circumference of the bore wall opposite the first semi-circumference, the first semi-circumference of the bore wall has an exterior convex surface curvature which is concentric with the axis of turning and the cover comprises a concave surface curvature which confronts the exterior convex surface curvature of the first semi-circumference of the bore wall throughout turning of the barrel between the first position and the second position.

15. A device as set forth in claim 12 in which the bore wall has opposite axial ends between which the inlet port and the outlet port are disposed, and in which the barrel protrudes from the bore at a first of the opposite axial ends of the bore wall into operative coupling with the operator;

the cover including a tongue which extends from the cover radially inward relative to the axis of turning of the barrel to overlap a second of the opposite axial ends of the bore wall for cooperating with the operator to axially capture the barrel, the cover, and the operator on the bore wall throughout turning of the barrel about the axis of turning between the first position and the second position.

16. A device as set forth in claim 15 in which the operator the barrel, and the cover are embodied in a single molded part.

17. A device for use on a container which contains a semi-solid to selectively allow and disallow passage of semi-solid through the device, the device comprising:

a housing comprising an inlet port through which semi-solid from a container can enter the housing, an outlet port through which semi-solid which has entered the housing through the inlet port can exit the housing, and a bore;

a barrel which fits, and can turn, within the bore about an axis of turning;

an operator which is outside the housing for turning the barrel in unison with turning of the operator about the axis of turning;

the barrel comprising a through-passage which, when the operator has turned the barrel to a first position, registers the inlet port to the outlet port to allow passage of semi-solid through the device, and which, when the operator has turned the barrel to a second position, unregisters the inlet port to the outlet port to disallow passage of semi-solid through the device;

and a cover which is external to and extends from the operator for selective positioning by the operator to occlude the outlet port when the operator has turned the barrel to the second position and to not occlude the outlet port when the operator has turned the barrel to the first position;

in which the bore wall has opposite axial ends between which the inlet port and the outlet port are disposed, and in which the barrel protrudes from the bore at a first of the opposite axial ends of the bore wall into operative coupling with the operator;

the cover including a tongue which extends from the cover radially inward relative to the axis of turning of the barrel to overlap a second of the opposite axial ends of the bore wall for cooperating with the operator to axially capture the barrel, the cover, and the operator on the bore wall throughout turning of the barrel about the axis of turning between the first position and the second position.

18. A device as set forth in claim 17 in which the operator, the barrel, and the cover are embodied in a single molded part.

19. A device as set forth in claim 18 in which the housing, including the bore wall, comprises a single molded part.

20. A device as set forth in claim 17 further comprising an engagable detent which is disposed between the operator and the housing for engagement at the second position of turning of the barrel.

* * * * *